US007163392B2

(12) United States Patent
Feese et al.

(10) Patent No.: US 7,163,392 B2
(45) Date of Patent: Jan. 16, 2007

(54) THREE STAGE LOW $NO_X$ BURNER AND METHOD

(76) Inventors: James J. Feese, 854 Mount Gretna Rd., Elizabethtown, PA (US) 17022; Bruce A. Wartluft, 2548 Long La., Lebanon, PA (US) 17042

( * ) Notice: Subject to any disclaimer, the term of this patent is extended or adjusted under 35 U.S.C. 154(b) by 321 days.

(21) Appl. No.: 10/933,840

(22) Filed: Sep. 3, 2004

(65) Prior Publication Data

US 2005/0053877 A1 Mar. 10, 2005

Related U.S. Application Data

(60) Provisional application No. 60/500,599, filed on Sep. 5, 2003.

(51) Int. Cl.
*F23M 3/04* (2006.01)
*F23M 3/02* (2006.01)
*F23C 7/00* (2006.01)

(52) U.S. Cl. ..... 431/10; 431/8; 431/116; 431/181; 431/187

(58) Field of Classification Search ..... 431/10, 431/8, 9, 115, 116, 181, 182, 187, 188
See application file for complete search history.

(56) References Cited

U.S. PATENT DOCUMENTS

| | | | |
|---|---|---|---|
| 3,729,285 | A | 4/1973 | Schwedersky |
| 3,909,188 | A | 9/1975 | Velie |
| 4,011,995 | A | 3/1977 | Krause, Jr. |
| 4,240,784 | A | 12/1980 | Dauvergne |
| 4,298,337 | A | 11/1981 | Butler et al. |
| 4,559,009 | A | 12/1985 | Marino et al. |
| 4,626,195 | A | 12/1986 | Sato et al. |
| 4,748,919 | A | 6/1988 | Campobenedetto et al. |
| 4,790,743 | A | 12/1988 | Leikert et al. |
| 4,815,966 | A | 3/1989 | Janssen |
| 4,867,572 | A | 9/1989 | Brock et al. |
| 4,986,748 | A | 1/1991 | Brown et al. |
| 5,192,204 | A | 3/1993 | Musil |
| 5,203,693 | A | 4/1993 | Swanson |
| 5,240,410 | A | 8/1993 | Yang et al. |
| 5,257,927 | A | 11/1993 | Lang |
| 5,259,755 | A | 11/1993 | Irwin et al. |
| 5,368,472 | A | 11/1994 | Hovis et al. |
| 5,411,394 | A | 5/1995 | Beer et al. |
| 5,413,477 | A | 5/1995 | Moreland |

(Continued)

FOREIGN PATENT DOCUMENTS

| | | |
|---|---|---|
| JP | 4 124 519 A2 | 4/1992 |

(Continued)

*Primary Examiner*—Alfred Basichas
(74) *Attorney, Agent, or Firm*—McNees Wallace & Nurick LLC

(57) ABSTRACT

The present invention is an air-staged low $NO_x$ burner for firing a gaseous fuel. The burner fires three stages, with the first stage of combustion taking place substantially within a burner cup section of a refractory baffle, the second stage of combustion taking place adjacent to the baffle and downstream of the baffle, and the third stage of combustion within a furnace. The flow of main combustion air adjacent to the baffle creates a negative pressure zone adjacent to the baffle. The present invention is also a method for low $NO_x$ staged combustion.

41 Claims, 11 Drawing Sheets

U.S. PATENT DOCUMENTS 5,415,539 A 5/1995 Musil
5,511,970 A 4/1996 Irwin et al.
5,567,141 A 10/1996 Joshi et al.
5,571,006 A 11/1996 Nakamachi et al.
5,700,143 A 12/1997 Irwin et al.
5,782,626 A 7/1998 Joos et al.
5,807,094 A 9/1998 Sarv
5,813,847 A 9/1998 Eroglu et al.
5,871,343 A 2/1999 Baukal, Jr. et al.
5,954,855 A 9/1999 Gitman et al.
5,993,199 A 11/1999 Safarik
6,007,325 A 12/1999 Loftus et al.
6,019,595 A 2/2000 Wulfert et al.
6,048,197 A 4/2000 Beiler
6,056,538 A 5/2000 Buchner et al.
6,112,676 A * 9/2000 Okazaki et al. ..... 110/261
6,189,464 B1 2/2001 Okazaki et al.
6,260,773 B1 7/2001 Kamath
6,347,935 B1 2/2002 Schindler et al.
6,488,496 B1 12/2002 Feese et al.
6,652,268 B1 11/2003 Irwin et al.

FOREIGN PATENT DOCUMENTS

WO WO 01/35022 A1 5/2001

* cited by examiner

THREE STAGE LOW $NO_X$ BURNER AND METHOD

CROSS-REFERENCE TO RELATED APPLICATIONS

This application claims the benefit of U.S. Provisional Application No. 60/500,599, filed Sep. 5, 2003, which application is incorporated herein by reference.

FIELD OF THE INVENTION

The present invention is generally directed to an air staged low nitrogen oxide burner.

BACKGROUND OF THE INVENTION

One of the by-products created by the combustion of hydrocarbon (HC) fuels in burners that use atmospheric air is nitrogen oxide ($NO_x$). A well-known problem in the industry for many years with the use of conventional burner designs utilizing preheated combustion air is higher flame temperatures which in turn contribute to an exponential increase in NOx emissions. Efforts to save fuel and increase combustion efficiency via recuperative and/or regenerative combustion systems combined with stricter governmental permitting laws for acceptable $NO_x$ emissions from furnaces has led to a much greater awareness and need to solve this problem in recent years. Ideally, the only by-products of stoichiometric hydrocarbon combustion should be water ($H_2O$), carbon dioxide ($CO_2$), and nitrogen ($N_2$) with no carbon monoxide (CO), unburned hydrocarbons HC's, or $NO_x$ emissions. In addition, for maximum fuel efficiency the combustion reaction should proceed with as little excess air, which is air that is above the stoichiometric quantity of air necessary for complete combustion, as possible while minimizing the production of $NO_x$. Another consideration is during cold furnace startup, when HC and CO emissions can be relatively high due to flame quenching from low furnace temperatures.

Techniques for controlling and inhibiting $NO_x$ formation in furnace combustion processes are well known and may include, for example, provisions for staging fuel, staging combustion air, recirculating flue gas into the burner, recirculating flue gas into the burner flame, altering combustion patterns with different degrees of swirl, and injection of water or steam into the burner or flame. Factors that contribute to the formation of $NO_x$ in burner-fired combustion chambers are the oxygen content of the flame or combustion chamber, the temperature of the combustion chamber, the temperature of the combustion air, the burner-firing rate, turbulence, and the residence time for complete combustion. It is known that $NO_x$ emissions increase with combustion chamber temperatures, the temperature of the combustion air, residence time, and typically with oxygen content in the combustion chamber. However, these factors are difficult to predict because burners for different industrial processes must operate at various furnace chamber temperatures, have various oxygen concentrations in the work chambers, may or may not have preheated combustion air, and are required to operate at different heat inputs depending on changing heat load requirements.

High Momentum ("HM") burners, such as the burner disclosed in U.S. Pat. No. 4,431,403 and the burner disclosed in U.S. Pat. No. 4,443,182, both assigned to the assignee of the present invention are examples of burners that produce high levels of $NO_x$ during operation.

Previous efforts to solve the problem include the Staged Air, Low $NO_x$ Burner with Internal Recuperative Flue Gas Recirculation, U.S. Pat. No. 5,413,477. This design utilizes a combination of air staging and flue gas recirculation (FGR) for $NO_x$ reduction. However, the added capital expense for piping and controlling the recirculated flue gases are substantial.

Another embodiment by Bloom Engineering Co., Inc. details an air staged swirl burner, International Patent No. WO 01/35022 A1, for lower $NO_x$ emissions but does not address the cold furnace startup issue. In addition, there is still room for improvement in reducing the burner $NO_x$ emissions.

Finally, Tokyo Gas Co., Ltd. describes an air staging method for lower $NO_x$ emissions from burners incorporating regenerative beds in the burner body, U.S. Pat. No. 5,571,006. However, this design requires a separate ambient air connection to the burner body for flame stabilization and complete fuel burnout during cold furnace startups and/or below the auto ignition temperature of the fuel gas, again adding maintenance, installation, and operation costs.

What is needed is a gas burner that is capable of very low NOx emissions when fired on either ambient or preheated combustion air. The burner should also reduce carbon monoxide CO and hydrocarbon HC emissions during cold furnace startups. It should reduce emissions without the added expense of multiple air and/or fuel connections.

SUMMARY OF THE INVENTION

The present invention is an air-staged low $NO_x$ burner for firing a gaseous fuel comprising a first downstream end and a first upstream end. The burner further comprises a main burner body having a second upstream end and a second downstream end. The burner further comprises a refractory baffle nested within the main burner body intermediate to the second upstream end and the second downstream end, the refractory baffle comprising a central axis, a third upstream end, a third downstream end, a downstream section having an outer surface to facilitate a portion of second stage combustion, a narrow portion at the third downstream end, and a wide portion upstream of the narrow portion, the outer surface of the downstream section converging toward the central axis of the refractory baffle at the third downstream end, and a burner cup section to promote a first stage combustion nested within the refractory baffle. The burner further comprises a fuel passage for supplying fuel for combustion, the fuel passage being in fluid communication with a fuel supply and the burner cup section of the refractory baffle, the fuel passage being nested within the refractory baffle. The burner further comprises a main combustion air inlet section for supplying main combustion air, the main combustion air inlet section being in fluid communication with a low pressure main combustion air supply and the refractory baffle. The burner further comprises a primary main combustion air passage having a fourth upstream end and a fourth downstream end and nested within the refractory baffle for supplying primary main combustion air to support fuel combustion in a first stage combustion region at a downstream end of the primary main combustion air passage and substantially within the burner cup, the primary main combustion air passage being in fluid communication with the main combustion air inlet section at the fourth upstream end, the first stage combustion region at the fourth downstream end, the fuel passage intermediate to the fourth upstream end and the fourth downstream end, and with the burner cup section at the fourth downstream end, the first stage combustion region positioned substantially within the burner cup section. The burner further comprises a secondary main combustion air passage having a fifth upstream end and a fifth downstream end and which passes through the refractory baffle for supplying secondary main combustion air for at least the second stage combustion to a second stage combustion region substantially within the main burner body, the second stage combustion region being located partially adjacent to and partially downstream of the third downstream end of the refractory baffle, the secondary main combustion air passage being in fluid communication with the main combustion air inlet section at the fifth upstream end and the second stage combustion region at the fifth downstream end. The burner further comprises a tertiary main combustion air passage having a sixth upstream end and a sixth downstream end downstream of the second downstream end of the main burner body for supplying tertiary main combustion air for a third stage combustion to a third stage combustion region, the tertiary main combustion air passage being in fluid communication with the main combustion air inlet section, the third stage combustion region being located downstream of the first downstream end.

The present invention is also an air-staged low $NO_x$ burner for firing using a gaseous fuel comprising a first upstream end and a first downstream end. The burner further comprises a main burner body having a second upstream end and a second downstream end. The burner further comprises a refractory baffle nested within the main burner body intermediate to the second upstream end and the second downstream end, the refractory baffle having a third upstream end and a third downstream end and being configured to facilitate first stage combustion in a first stage combustion region substantially within the baffle and being configured to facilitate second stage combustion in a second stage combustion region partially adjacent to an outer surface of the baffle by promoting a negative pressure zone upstream of the third downstream end, the second stage combustion region also being partially downstream of the third downstream end. The burner further comprises a fuel passage for supplying fuel for combustion, the fuel passage being in fluid communication with a fuel supply and the burner cup section of the refractory baffle, the fuel passage being nested within the refractory baffle. The burner further comprises a main combustion air inlet section for supplying main combustion air, the main combustion air inlet section being in fluid communication with a low pressure main combustion air supply and the refractory baffle. The burner further comprises a primary main combustion air passage having a fourth upstream end and a fourth downstream end and being nested within the refractory baffle for supplying primary main combustion air to support fuel combustion in a first stage combustion region at a downstream end of the primary main combustion region and substantially within the burner cup, the primary main combustion air passage being in fluid communication with the main combustion air inlet section at the fourth upstream end, the first stage combustion region at the fourth downstream end, the fuel passage intermediate to the fourth upstream end and the fourth downstream end, and with the first stage combustion section at the fourth downstream end. The burner further comprises a secondary main combustion air passage having a fifth upstream end and a fifth downstream end and nested within the refractory baffle for supplying secondary main combustion air for at least second stage combustion to the second stage combustion region, the second stage combustion region being located partially adjacent to and partially downstream of the outer surface of the refractory baffle, the secondary main combustion air passage being in fluid communication with the main combustion air inlet section at the fifth upstream end and the second stage combustion region at the fifth downstream end. The burner further comprises a tertiary main combustion air passage having a sixth upstream end and a sixth downstream end downstream of the second downstream end of the main burner body for supplying tertiary main combustion air for third stage combustion to a third stage combustion region, the tertiary main combustion air passage being in fluid communication with the main combustion air inlet section, the third stage combustion region being located downstream of the second downstream end.

The present invention is also a refractory baffle for an air-staged low $NO_x$ burner comprising a first upstream end and a first downstream end, the baffle being configured for installation into a burner such that the first upstream end is positioned nearer to a second upstream end of the burner than the first downstream end and such that the first downstream end is positioned nearer to a second downstream end of the burner than the first upstream end. The baffle further comprises a central axis. The baffle further comprises a burner cup section nested within the refractory baffle, the cup section being configured to receive fuel and main combustion air, the cup section having apertures through which fuel and combustion air flows during burner operation to promote a first stage combustion during burner operation. The baffle further comprises a downstream section having an outer surface to facilitate a partial second stage combustion during burner operation, the downstream section having a narrow portion at the first downstream end and a wide portion upstream of the narrow portion, the outer surface converging toward the central axis of the refractory baffle at the first downstream end.

The present invention is also a refractory baffle for an air-staged low $NO_x$ burner comprising a first upstream end and a first downstream end, the baffle being configured for installation into a burner such that the first upstream end is positioned nearer to a second upstream end of the burner than the first downstream end and such that the first downstream end is positioned nearer to a second downstream end of the burner than the first upstream end. The baffle further comprises a burner cup section being configured to promote a first stage combustion during burner operation and being configured to receive fuel and main combustion air. The baffle further comprises a downstream section having an outer surface to facilitate a partial second stage combustion during burner operation, the downstream section having a narrow portion at the first downstream end and a wide portion upstream of the narrow portion, the outer surface converging toward the central axis of the refractory baffle at the first downstream end.

The present invention is also a method for low NOx staged combustion, comprising providing main combustion air from a main combustion air supply, the main combustion air supply being in fluid communication with a burner. The method also comprises introducing the main combustion air into the burner and dividing the main combustion air within the burner into a primary main combustion air stream, a secondary main combustion air stream, and a tertiary main combustion air stream. The method also comprises providing fuel for combustion from a fuel supply, the fuel supply being in fluid communication with a fuel passage. The method also comprises introducing the fuel into the fuel passage. The method also comprises flowing the primary main combustion air stream into a burner cup section of a refractory baffle, the burner cup section being in fluid communication with the fuel passage, the refractory baffle being nested within the burner and having and upstream end and a downstream end. The method also comprises drawing a first portion of the fuel into the burner cup section, while mixing the first portion of fuel with the primary main combustion air stream to form a first mixture. The method also comprises at least partially combusting the first mixture substantially within the burner cup section by igniting the first mixture for a first stage of combustion. The method also comprises introducing the secondary main combustion air stream adjacent to an outer surface of the baffle, wherein the interaction between the secondary main combustion air stream and the outer surface of the baffle creates a negative pressure zone at least upstream of the downstream end of the baffle. The method also comprises drawing at least a second portion of the fuel into the negative pressure zone, which drawing, in conjunction with the introduction of the secondary main combustion air stream creates a second mixture. The method also comprises at least partially combusting the second mixture at least partially within the negative pressure zone by igniting the second mixture for a second stage of combustion. The method also comprises flowing the products of the first stage of combustion and the second stage of combustion along with any uncombusted fuel and any unreacted primary main combustion air and secondary main combustion air into the furnace. The method also comprises introducing the tertiary main combustion air stream into a furnace. The method also comprises igniting substantially all of the uncombusted fuel in the furnace for a third stage of combustion.

The present invention is also a method for low NOx staged combustion, comprising providing a burner, the burner having an upstream end, a downstream end and an outer shell. The present invention also comprises providing main combustion air from a main combustion air supply, the main combustion air supply being in fluid communication with a burner. The present invention also comprises introducing the main combustion air into a burner. The present invention also comprises providing fuel for combustion from a fuel supply, the fuel supply being in fluid communication with a burner. The present invention also comprises introducing the fuel into the burner. The present invention also comprises combusting a first portion of the fuel using a first portion of main combustion air in a first stage combustion region, the first stage combustion region being located at least substantially within a refractory baffle. The present invention also comprises combusting at least a second portion of the fuel using at least a second portion of main combustion air in a second stage combustion region, the second stage combustion region being located at least partially adjacent to an outer surface of the refractory baffle, the second stage combustion region being partially located upstream of the first stage combustion region, wherein at least a portion of the second stage combustion region is located within a negative pressure zone. The present invention also comprises combusting at least a third portion of the fuel using at least a third portion of main combustion air in a third stage combustion region, the third stage combustion region being located outside the burner.

The low NOx burner of the present invention has one air connection and one fuel connection. The low NOx burner of the present invention reduces the emission of CO and HC during cold furnace startups due to burner design improvements. The burner of the present invention is designed to heat the interior of a furnace for high-temperature combustion/furnace processes such as aluminum melting and steel processes. However, the burner of the present invention can also be used for low temperature processes, at temperatures below the auto-ignition temperature of the fuel and still produce very low CO, HC and $NO_x$ emissions.

The burner comprises two main elements, a main burner body, which is positioned within an aperture within a furnace wall such that there is an exterior portion of the main burner body and an interior portion of the main burner body and a section separate from the main burner body that is entirely internal to the main burner body. Most of the elements of the burner are nested within a main burner body shell. The internal section of the burner comprises an interior burner file or port block that is nested within an interior metal shell. The main burner body shell and some of the elements within the main burner body shell comprise metal or metal alloy capable of operating in high temperature conditions such as steel selected from the group consisting of mild steel, carbon steel, stainless steel, and combinations thereof.

The low $NO_x$ burner of the present invention utilizes three stages of low pressure main combustion air supplied by a low pressure air supply such as, for example, a fan, in communication with a low $NO_x$ burner by a single combustion air connection. The burner is mounted to a furnace and passes through a furnace wall.

The main combustion air is supplied to the burner through an air inlet section mounted to a main burner body. As the combustion air enters the burner, it is diverted within the burner body by a separation plate, which separates the air into two portions. The first portion of main combustion air travels into an internal burner chamber while the second portion of main combustion air enters a tertiary air passage. The amount of air split between the internal burner chamber, primary and secondary air, and the tertiary air passage can be controlled through the use of a switching valve, which can be associated with the control system or rotated manually. The control system also controls the supply of fuel and main combustion air to the burner. A separation tube nested within the burner body directs the first portion of main combustion air into a refractory baffle. The refractory baffle separates the first portion of main combustion air into primary main combustion air that travels through at least one primary air passage, and into secondary main combustion air that travels through secondary main combustion air passages in the refractory baffle. The refractory baffle is nested within a refractory ring. The refractory ring is nested within the burner shell.

The refractory baffle has a centerline, an upstream end, a downstream end, and a substantially frustro-conical portion. The substantially frustro-conical portion has an outer radial surface to facilitate second stage combustion. The frustro-conical portion of the refractory baffle has a most narrow portion at the downstream end of the refractory baffle and a most wide portion upstream of the narrowest portion. The outer radial surface of the refractory baffle is angled away from the centerline of the refractory baffle at a reverse acute angle in the range of about 25 degrees to about 70 degrees. In addition, the refractory baffle has an optional flat planar downstream end surface to facilitate second stage combustion.

The gaseous fuel for combustion, which could be any gaseous fuel known in the art, such as, for example, natural gas, which enters the burner through a fuel inlet that is attached to the main burner body and is nested within the refractory baffle. The fuel enters a fuel passage nested within the burner and travels through the fuel passage and into a burner cup, which is nested within the refractory baffle. The fuel passage has an upstream end in fluid communication with the fuel inlet section and a downstream end in fluid communication with the burner cup and the primary main combustion air passage. Some of the fuel initially enters the primary air passage, is known as "bleed fuel," and is ignited adjacent to the burner cup by means known in the art, such as a gas pilot ignition or spark igniter. The bleed fuel is generally about 1 percent to about 20 percent of the total fuel for combustion. The first stage combustion flame resulting from this first stage combustion attaches to the surface of the burner cup. Only a small portion of the fuel comprises bleed fuel. The remaining fuel is known as "main combustion fuel." The combustion of the bleed fuel is the first stage of combustion and occurs substantially adjacent to the burner cup, with the flame created by the first stage combustion being attached to the surface of the burner cup, which is also an inner surface of the refractory baffle. Some of the bleed fuel is only partially combusted.

The secondary main combustion air passage has an upstream end section and a downstream end section. A portion of the main combustion fuel and the products of first stage combustion are drawn into a second stage combustion region that is adjacent to the radial surface of the frustro-conical portion of the refractory baffle. The downstream end section of the secondary main combustion air passage is sloped such that the aperture formed by the downstream end is sloped away from the centerline of the refractory baffle, optionally at the same reverse acute angle as the frustro-conical portion.

The physical effects of the flow of the secondary main combustion air out of the secondary main combustion air passage coupled with the reverse angle of the frustro conical portion creates a negative pressure zone adjacent to the radial surface of the frustro-conical portion and adjacent to the planar end surface of the refractory baffle. The products of first stage combustion and additional fuel are drawn back against the radial surface of the frustro-conical portion and the planar end surface of the refractory baffle. Combustion of fuel that is drawn back against the radial surface and the planar end surface and the further combustion of any partially combusted products of first stage combustion occur in the second stage combustion region of the burner. Additional second stage combustion takes place downstream of the refractory baffle within the second stage combustion chamber, which is defined as the area including downstream of the refractory baffle frustro-conical portion to the end of the burner tile and bounded by the refractory ring and an inner diameter of the interior burner tile.

The remainder of the combustion, or third stage combustion takes place in the furnace. The tertiary main combustion air passage passes through the refractory ring, and the interior burner tile. The tertiary main combustion air does not participate in the combustion of the fuel until it enters the furnace. The remainder of the fuel that was not combusted in the first stage or the second stage is combusted in the third stage combustion region using third stage combustion air within the furnace.

An advantage of the present invention is that it provides a gas burner capable of very low $NO_x$ emissions when fired with either ambient or preheated combustion air.

Another advantage of the present invention is that it reduces emissions of CO and HCs during cold furnace startups.

Another advantage of the present invention is that it is capable of a significant reduction in energy output, known as high turndown, while maintaining low excess air at or near stoichiometric operation.

Another advantage of the present invention is that a portion of the flame is visible and stable under all firing conditions, which promotes flame safety.

Another advantage is that many of the elements of the present invention are refractory and are capable of withstanding very high air preheat and furnace temperatures.

A further advantage of the present invention is that it easier to maintain, install, and operate as only a single fuel and a single air inlet connection to the burner is required.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
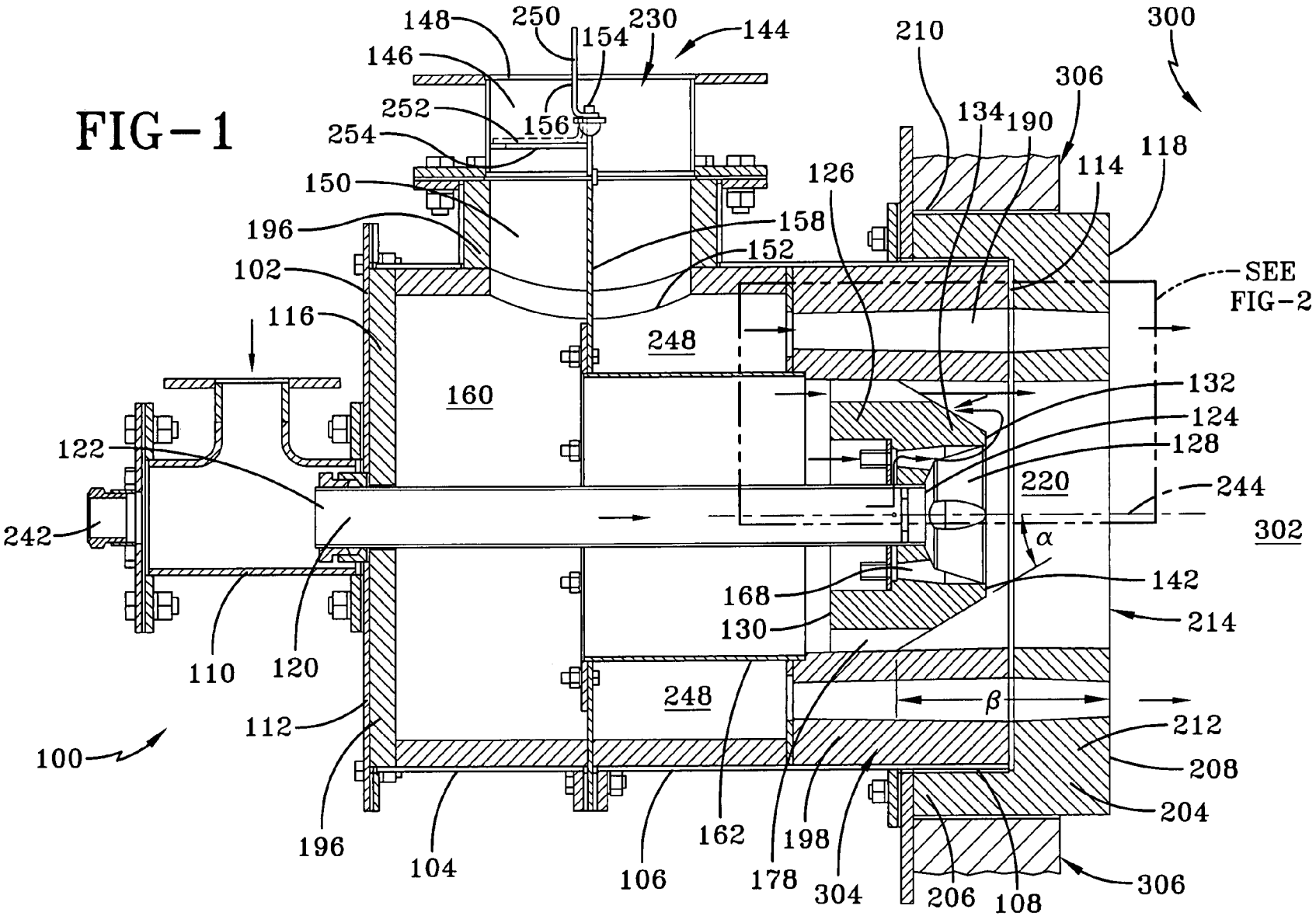
FIG. 1 is a cross-sectional view of the low $NO_x$ burner of the present invention.

FIG. 1, FIG. 2, FIG. 8, FIG. 9, and FIG. 10 depict a cross-section of an embodiment of the burner 100 of the present invention. The burner 100 of the present invention has a main burner body 102, which contains most of the elements of burner 100. A main burner body shell 104 encapsulates the main burner body 102. The main burner body shell 104 preferably comprises a material selected from the group consisting of carbon steel, stainless steel, and combinations thereof, although any metal or high temperature metal alloy may be used for the main burner body shell 104. The burner 100 extends into the interior 302 of the furnace 300 through an aperture 304 in the furnace wall 306. The burner 100 comprises two main elements, the main burner body 102 and the interior section 204, which is mounted within the furnace wall 306. The interior portion 108 of the main burner body is nested within the interior section 204.

The burner 100 has an upstream end 116 and a downstream end 118. The main burner body 102 has an upstream end 112 and a downstream end 114, while the interior section 204 has an upstream end 206 and a downstream end 208. The upstream end 116 of the burner 100 is also the upstream end 112 of the main burner body 102, while the downstream end 118 of the burner 100 is also the downstream end 208 of the interior section 204.

The gaseous fuel for combustion, which could be any gaseous fuel known in the art, such as, for example, natural gas, is provided through a fuel inlet section 110 that is positioned at the upstream end 112 of the main burner body 102. The fuel inlet section 110 is in fluid communication with a gaseous fuel source. An observation port 242 for observation of the burner flame is attached to the fuel inlet section 110. Fuel flows from the fuel inlet section 110 into a fuel passage 120. The fuel passage 120 has an upstream end 122 and a downstream end 124. The fuel passage is nested within a refractory baffle 126 and opens into and is in fluid communication with a burner cup section 128 of a refractory baffle 126, which is also an inner surface of refractory baffle 126. Refractory baffle 126, having a centerline 244, is nested within a refractory ring 198. As shown, centerline 244 of refractory baffle 126 is also the centerline of refractory ring 198 and fuel passage 120.

Figure 6:
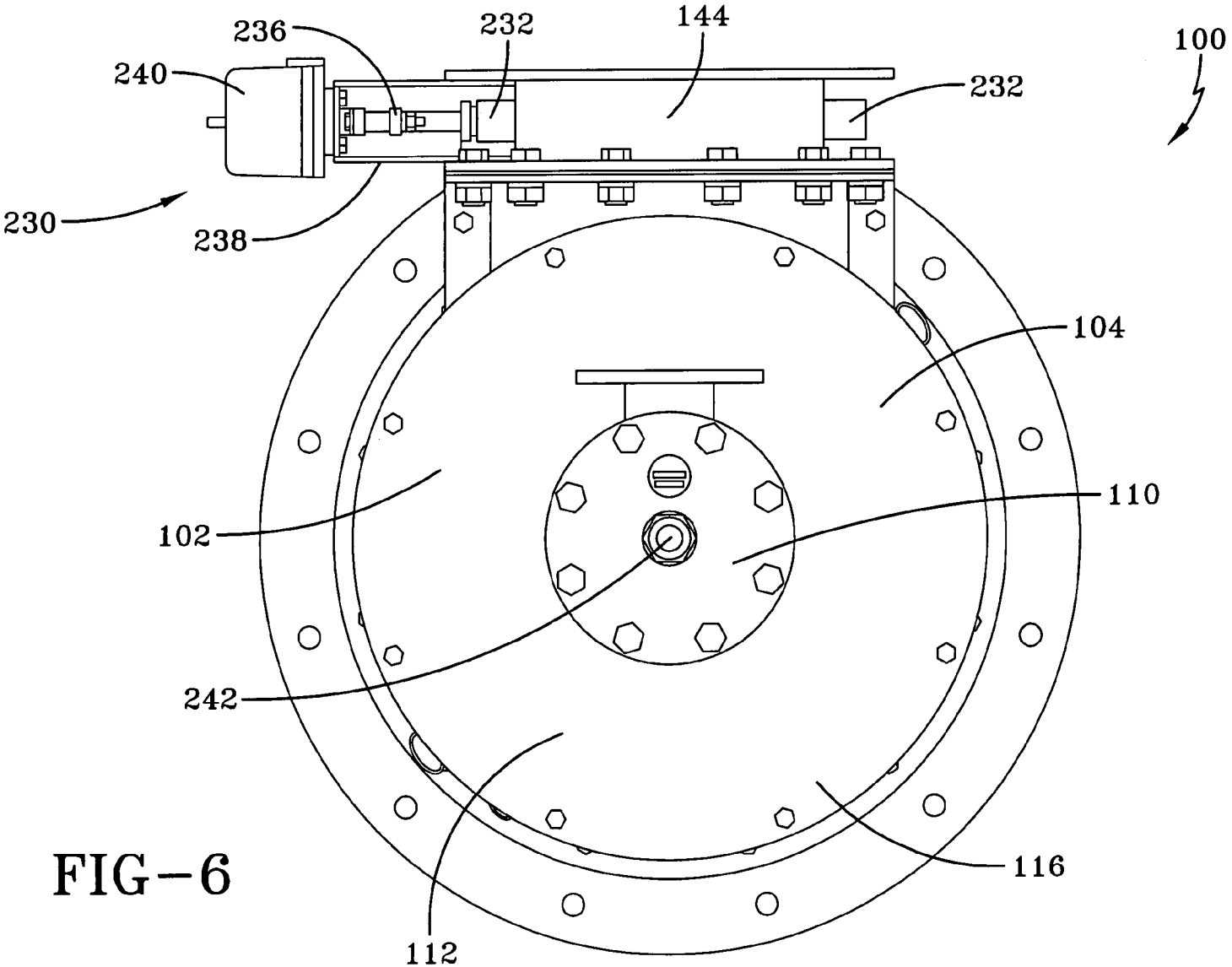
FIG. 6 is a rear view of the low NOx burner of the present invention.

The main combustion air, which provides substantially all of the air of combustion, is supplied to the burner 100 through an air inlet section 144. The main combustion air inlet pressure is preferably equal to or less than about 16 osig. The main combustion air inlet pressure is more preferably equal to or less than about 12 osig. As shown in FIG. 6, the provision of main combustion air to the burner 100 is controlled through the use of a valve assembly 230. A valve motor 240, which is connected to a source of electric power as known in the art and which is mounted to a mounting bracket 238, drives a valve shaft 236, which is mounted to bushings 232. The valve motor 240 is preferably controlled by a control system (not shown), which moves the valve position as a function of furnace temperature. The control system is a controller connected to at least one temperature sensor, the controller positioning the valve in response to the temperature of the furnace detected by at least one temperature sensor. Alternatively, the valve may be manually actuated.

Figure 2:
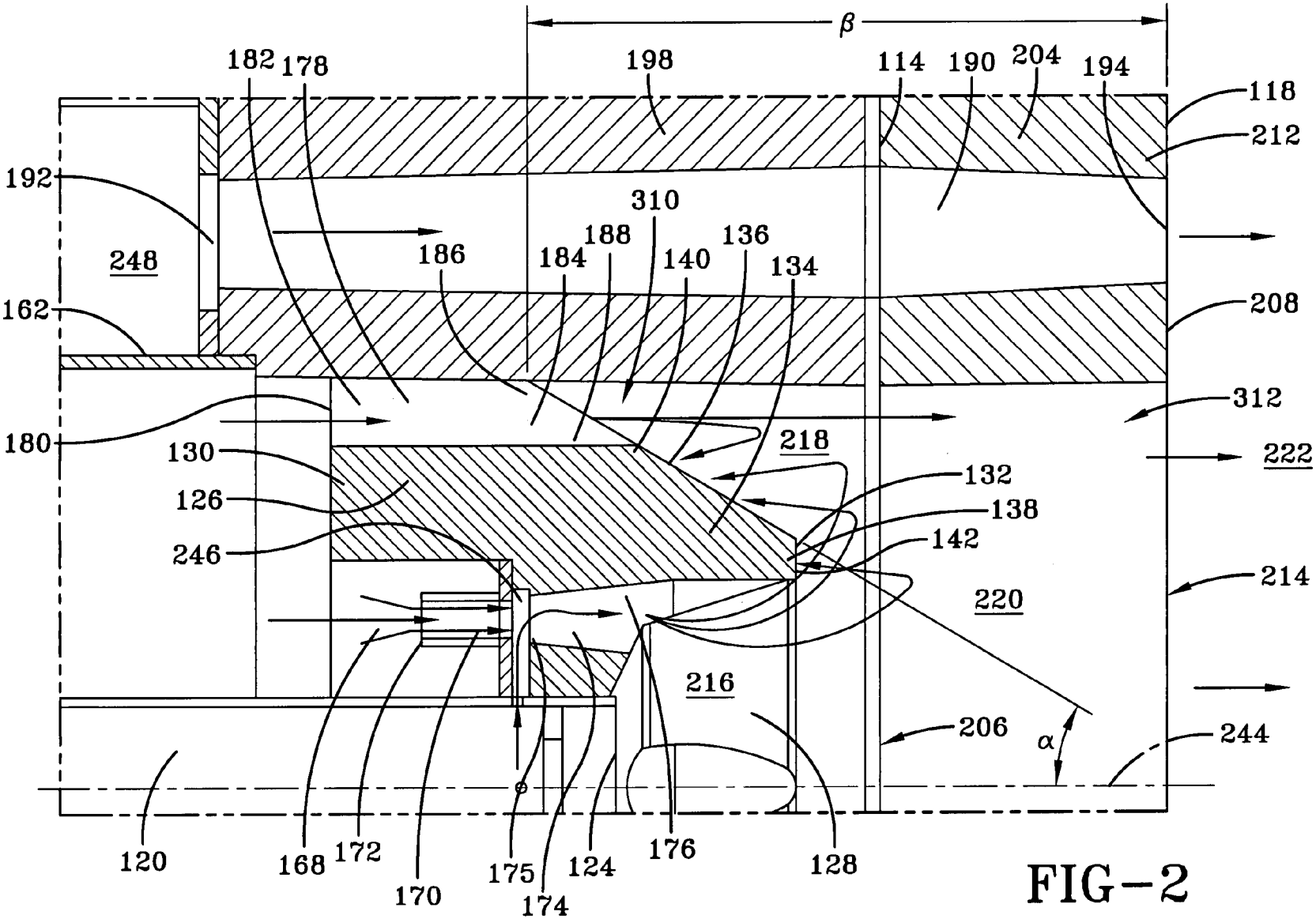
FIG. 2 is an enlarged cross-sectional view of the first stage combustion region and second stage combustion region of the low $NO_x$ burner of the present invention.

Referring again to FIG. 1, FIG. 2, FIG. 8, FIG. 9, and FIG. 10, the air inlet section 144 comprises an upstream portion 146, which also comprises the upstream end 148 of the air inlet section 144, and a downstream portion 150, which also comprises the downstream end 152 of the air inlet section 144. Internal insulation, such as ceramic fiberboard or refractory material, 196 is placed around the downstream portion 150 of the air inlet section 144 as well as within a substantial portion of the main burner body shell 104. In an optional embodiment, insulation may also be placed around the upstream portion 146 of the air inlet section 144, but such placement is not shown in FIG. 1, FIG. 2, FIG. 8, FIG. 9 or FIG. 10. In another optional embodiment, no insulation is used. As the main combustion air enters the air inlet section 144, the main combustion air is separated into two portions by a divider plate 158. The first portion of the main combustion air flows into a first internal burner chamber air supply 160, while the second portion of the main combustion air, also known as tertiary main combustion air, flows into a second internal burner chamber air supply 248. Referring also to FIG. 2, from the second internal burner chamber air supply 248, the tertiary main combustion air flows into a tertiary main combustion air passage 190, which has an upstream end 192 and a downstream end 194. The tertiary air passages pass from the upstream end 192 through the refractory ring 198, through an interior burner tile 212, which is also known in the art as a port block and terminated at the downstream end 194. The interior burner tile is nested within and supported by an interior metal shell 210. The tertiary main combustion air discharges at the downstream end 194 of the tertiary main combustion air passage 190 into the interior 302 of furnace 300.

Figure 3:
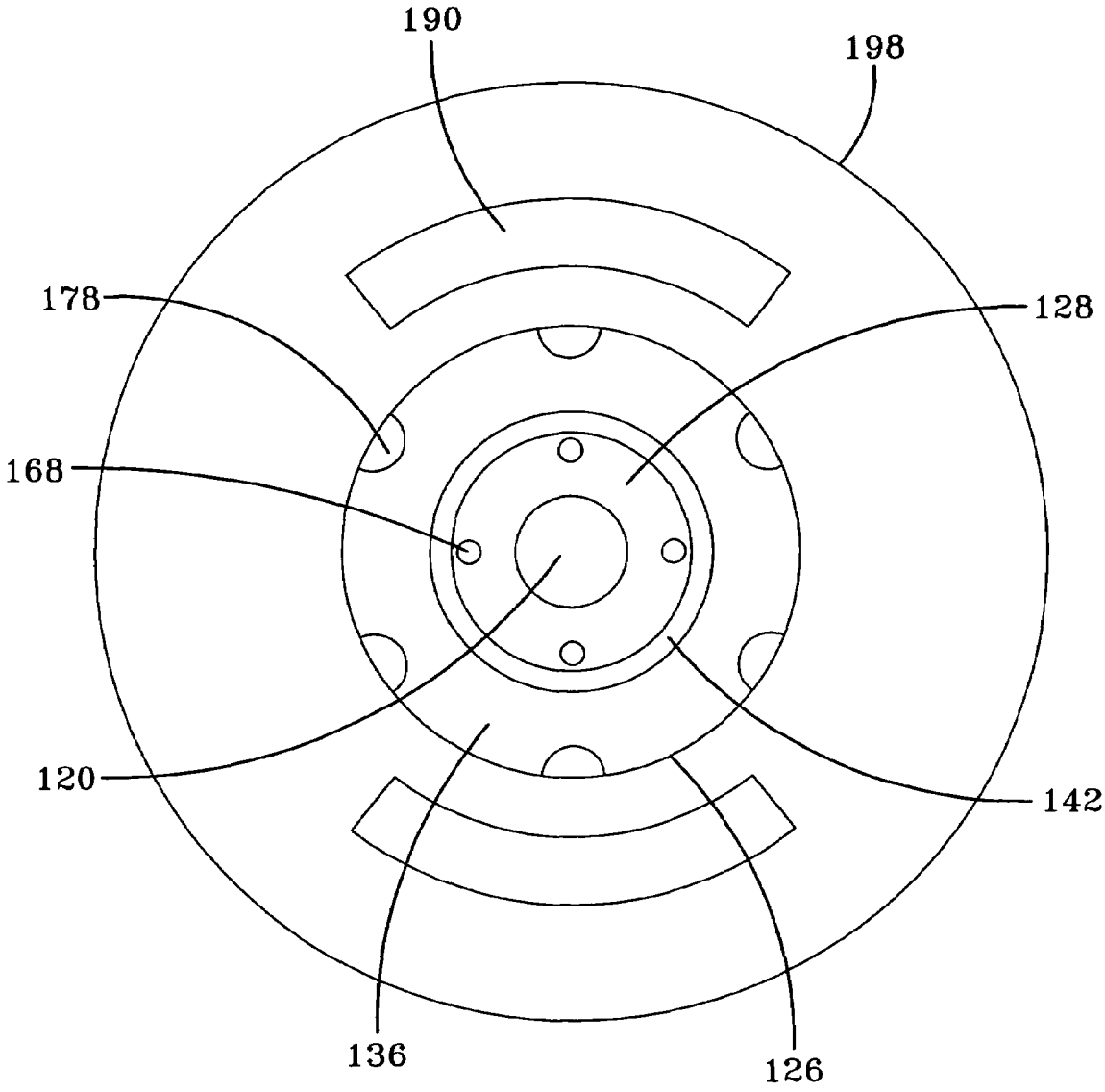
FIG. 3 is a front view of an embodiment of the refractory baffle and refractory ring of the present invention.
Figure 4:
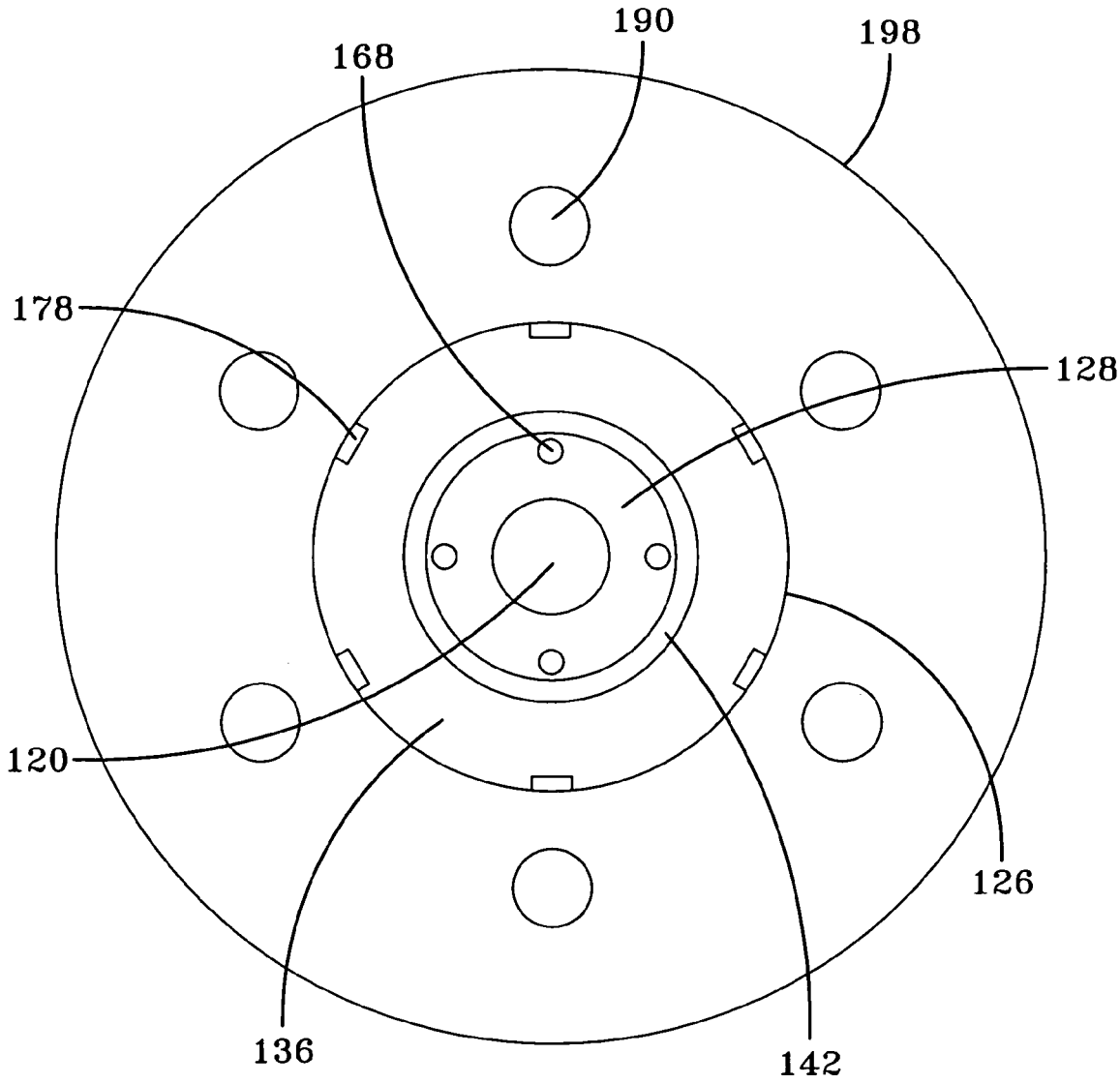
FIG. 4 is a front view of another embodiment of the refractory baffle and refractory ring of the present invention.
Figure 5:
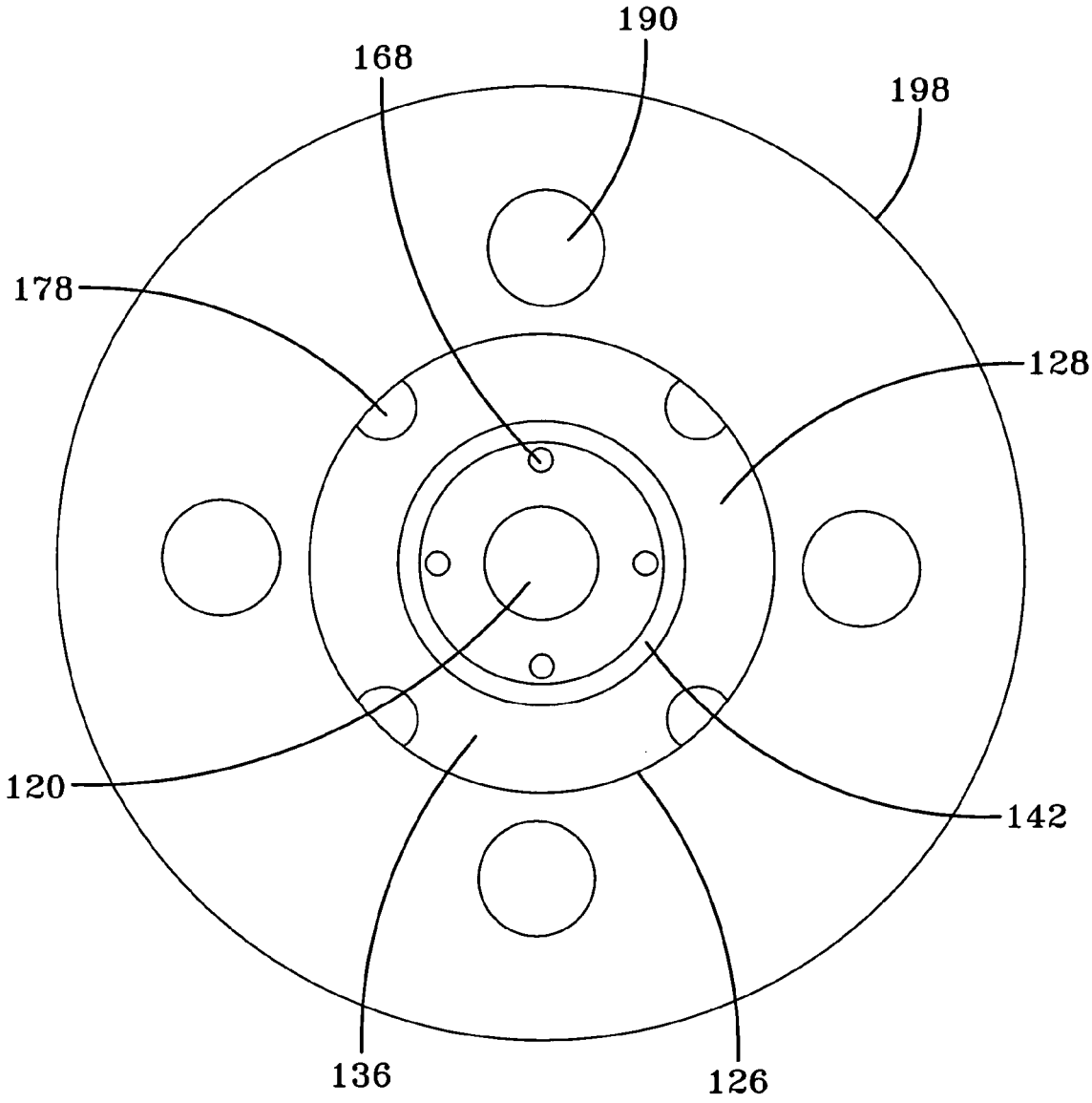
FIG. 5 is a front view of yet another embodiment of the refractory baffle and refractory ring of the present invention.

The tertiary main combustion air passage 190 may be of any functional geometric shape and the number of tertiary main combustion air passages 190 may vary. The present invention would function with as few as one or as many as six tertiary main combustion air passages 190. As shown in FIG. 1, FIG. 2, FIG. 3, FIG. 9, and FIG. 10, a preferred embodiment is two tertiary main combustion air passages 190 that are substantially annularly slot-shaped as the tertiary main combustion air discharges into the interior 302 of the furnace 300. In alternate embodiments, the main combustion air passages 190 may be in the shape of round apertures, semi-circular apertures, square apertures, rectangular apertures, or various segments of annular arc lengths. FIG. 4 shows an alternate embodiment with six tertiary main combustion air passages 190 that are substantially circular in cross-section as the tertiary main combustion air discharges into the interior 302 of the furnace 300. FIG. 5 shows another alternate embodiment with four tertiary main combustion air passages 190 that are substantially circular in cross-section as the tertiary main combustion air discharges into the interior 302 of the furnace 300. As few as one main combustion air passages 190 may be present. As shown in FIG. 11, which is another alternate embodiment, if one main combustion air passage 190 is used in the form of a 360° annulus, the refractory baffle 126 is provided in two separate pieces, a first section of the baffle 322 and a second section of the baffle 324.

Referring to FIG. 2, from the first internal burner chamber air supply 160, the first portion of the main combustion air flows into a separation tube 162. The first portion of the main combustion air is further separated into primary main combustion air that flows into the primary main combustion air passages 168 and into secondary main combustion air that flows into the secondary main combustion air passages 178.

The primary main combustion air passage 168 has an upstream portion 170, an upstream end 172, a downstream portion 174, and a downstream end section 176. The primary main combustion air first enters the upstream portion 170 of the primary main combustion air passage 168. As the primary main combustion air travels through the primary main combustion air passage 168, which is nested within the refractory baffle 126, venturi action at venturi tube 246 entrains bleed fuel for first stage combustion. The venturi tube 246 is in fluid communication with both fuel passage 120 and with primary main combustion air passage 168. The mixture of first stage bleed fuel and primary main combustion air flows through the downstream portion 174 of the primary main combustion air passage 168. The mixture of first stage bleed fuel and primary main combustion air begins to ignite and burn as it flows out the downstream end section 176 of the primary main combustion air passage 168 and into the burner cup section 128 of the refractory baffle 126. The downstream end section 176 of the primary main combustion air passage 168 transitions into the geometry of the burner cup section 128 and is positioned radially outward from the centerline 244 of refractory baffle 126.

The primary main combustion air passage 168 may be of any functional geometric shape and the number of primary main combustion air passages 168 may vary. In a preferred embodiment, there are four primary main combustion air passages 168 with downstream end sections 176 that appear to be substantially circular when viewed facing the downstream end 118 of the burner 100 as shown in FIG. 3, FIG. 4, FIG. 5, and FIG. 11 and there are four associated venturi tubes 246. In alternate embodiments, the appearance of the downstream end sections 176 could be in the shape of rectangular slots, annular slots, or round holes. The present invention would function with as few as two or as many as eight primary main combustion air passages 168 and associated venturi tubes 246.

As the first stage bleed fuel and primary main combustion air mixture passes through the primary main combustion air passage 168, the mixture is ignited and burns, continuing downstream into the burner cup section 128, creating the first stage of combustion for burner 100, which occurs in first stage combustion region 216. In a preferred embodiment, the main burner fuel is initially ignited using gas pilot ignition 226. In another preferred embodiment the fuel is initially ignited with a spark igniter 256 that extends down the center of the fuel passage 120. The first stage of combustion occurs substantially adjacent to the burner cup section 128 and the flame created by the first stage combustion attaches to the surface of the downstream end section 176 of the primary main combustion air passage 168 and burner cup section 128.

In addition to a burner cup section 128, the refractory baffle 126 has an upstream end 130, a downstream end 132, a substantially frustro-conical portion 134 beginning at the downstream end 132, and a planar end surface 142. The planar end surface is an optional preferred embodiment as the end of the substantially frustro-conical portion 134 may be any functional geometry including, but not limited to a rounded or radiused end surface, a tapered end surface, or an irregular end surface. The frustro-conical portion 134 has an outer surface 136, a most narrow portion 138 at the downstream end 132, and a most wide portion 140 upstream of the downstream end 132 and the narrowest portion 138. The outer surface 136 of the refractory baffle 126 is angled away from the centerline 244 of the refractory baffle 126 at a reverse acute angle $\alpha$. The reverse acute angle $\alpha$ is in the range of about 25° to about 70°. However, this reverse acute surface may also be a radiused surface.

The secondary main combustion air passage 178 has an upstream end 180, an upstream end section 182, and a downstream end section 184. The secondary main combustion air passage is nested within the refractory baffle 126. As shown clearly in FIG. 2, the downstream end section 184 has an upstream end 186 and a downstream end 188. The downstream end section 184 is angled back from the centerline 244 of the refractory baffle 126 at reverse acute angle $\alpha$ as the boundary of the downstream end section 184 is formed by the outer surface 136 of refractory baffle 126. In an alternate embodiment, the downstream end section 184 may be at a substantially right angle to the centerline 244. The secondary main combustion air travels through the secondary main combustion air passage 178 and out the downstream end section 184 of the secondary main combustion air passage 178.

The secondary air passage 178 may be of any functional geometric shape and the number of secondary main combustion air passages 178 may vary. In a preferred embodiment, there are six secondary main combustion air passages 178 with downstream end sections 184 that appear to be substantially semi-circular when viewed facing the downstream end 118 of the burner 100 as shown in FIG. 3. In alternate embodiments, as few as two or as many as ten secondary main combustion air passages 178 may be used. In alternate embodiments, the appearance of the downstream end sections 184 could be in any convenient geometric shape, such as the rectangular slots, annular slots, or round apertures. In an alternate embodiment, there are six secondary main combustion air passages 178 with downstream end sections 184 that appear to be annular slots when viewed facing the downstream end 118 of the burner 100 as shown in FIG. 4. In another alternate embodiment, there are four secondary main combustion air passages 178 with downstream end sections 184 that appear to be substantially semi-circular when viewed facing the downstream end 118 of the burner 100 as shown in FIG. 5. In yet another alternate embodiment, there are four secondary main combustion air passages 178 with downstream end sections 184 that appear to be substantially semi-circular when viewed facing the downstream end 118 of the burner 100 as shown in FIG. 11.

The physical effects of the flow of the secondary main combustion air out of the secondary main combustion air passage 178 coupled with the reverse angle $\alpha$ of the frustro conical portion 134 creates a negative pressure zone adjacent to the outer surface 136 of the frustro-conical portion 134 and adjacent to the planar end surface 142 of the refractory baffle 126. The products of first stage combustion, including partially combusted bleed fuel and additional main combustion fuel are drawn back against the outer surface 136 of the frustro-conical portion 134 and the planar end surface 142 of the refractory baffle 126. The combustion of the fuel that is drawn back against the outer surface 136 and the planar end surface 142 and the further combustion of any partially combusted products of first stage combustion is the second stage combustion of the burner. Additional second stage combustion of the main combustion fuel and the partial products of bleed fuel combustion takes place in the second stage combustion region 218 downstream of the refractory baffle 126 within the second stage combustion chamber 220, which is defined as the area downstream of the refractory baffle 126, but prior to the interior of the furnace 302 within the open middle of the refractory ring 198 and an aperture 214 within the interior burner tile 212. The second stage combustion region 218 has an upstream end 310 and a downstream end 312.

After the second stage combustion, a substantial amount of fuel remains either partially combusted or completely unburned. The remaining main combustion fuel and products of first and second stage combustion flow from the aperture 214 in the interior burner tile 212 into the interior 302 of furnace 300. Once the partially combusted products of first and second stage combustion and the remaining main combustion fuel enter the interior 302 of furnace 300, they mix with the tertiary main combustion air and entrained flue gases and combust within the interior 302 of furnace 300. The third stage combustion region is located within the interior 302 of furnace 300.

Figure 7:
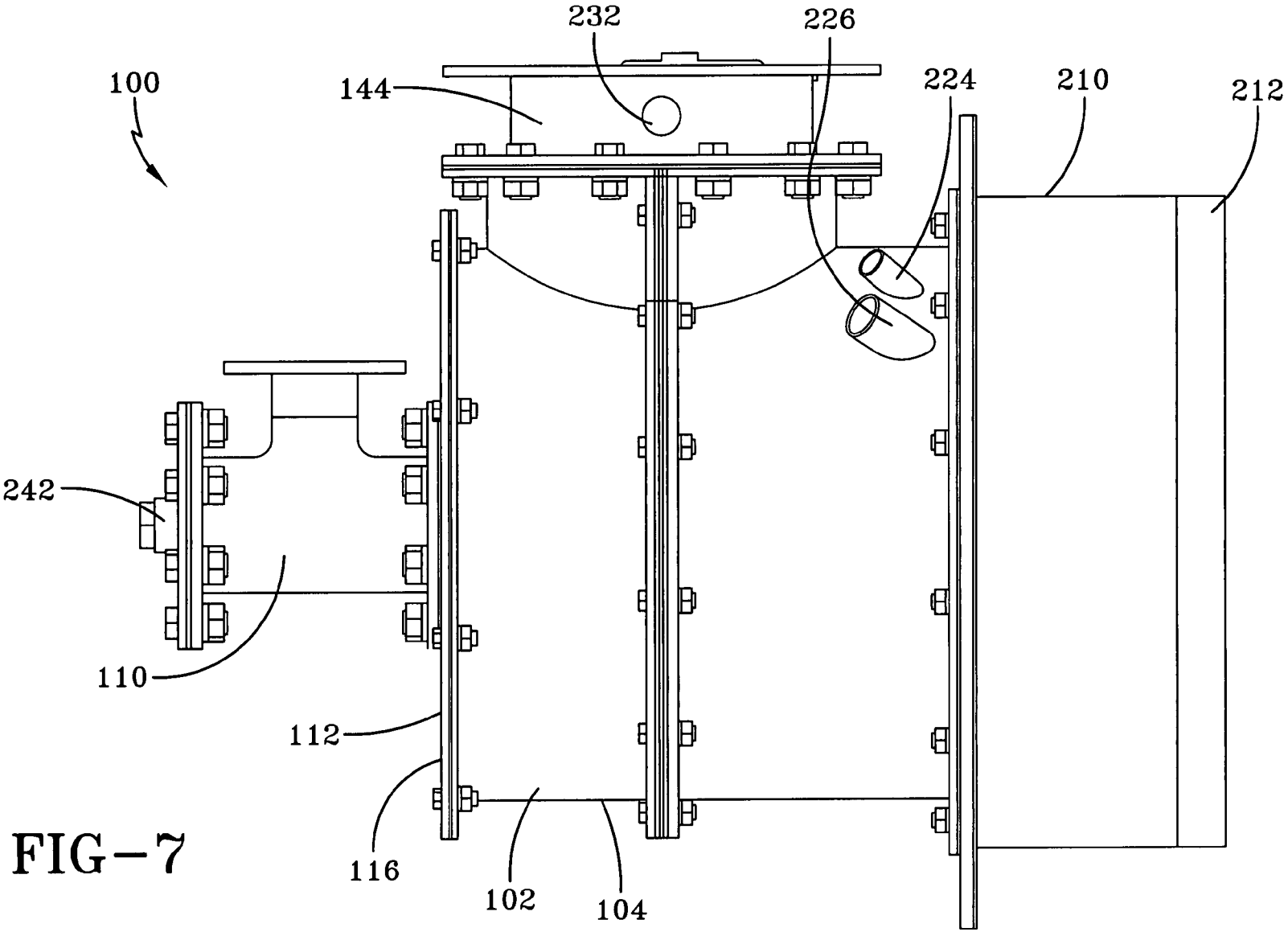
FIG. 7 is a side view of the low NOx burner of the present invention.

As shown in FIG. 7, there are optionally tubes that may extend from outside the main burner body shell, with two such tubes being shown in FIG. 7, beginning at a first pipe nipple 224 and a second pipe nipple 226 on FIG. 7, through the refractory ring 198 and exit into the second stage combustion region 218 downstream of the secondary main combustion air passage 178. There may be no such tubes or there may be in the range of one to four tubes. Optionally, there may be even more than four such tubes. Different types of devices may be placed onto the pipe nipples 224 and 226, such as an ultraviolet (UV) flame detector, an observation port, or a gas pilot if the optional gas pilot, which are all well known in the art, is included with the burner 100. Optionally the gas pilot is threaded onto a pipe nipple and extends partially through the tube such that the pilot flame extends into the second stage combustion region 218, where the pilot flame serves to ignite the fuel. In an optional embodiment there is only one tube. In another optional embodiment, there are no such tubes.

As shown in FIG. 1, FIG. 2, FIG. 8, FIG. 9, and FIG. 10, length β is the axial distance between the downstream end section 184 of secondary main combustion air passage 178 and the downstream end 118 of burner 100. In a preferred embodiment, length β is the axial distance between the upstream end 186 of the downstream end section 184 of secondary main combustion air passage 178 and the downstream end 118 of burner 100. In order to create an appropriate residence time for first stage combustion and second stage combustion, length β is designed to partially burn the HC's and CO of the main combustion fuel, so that there is a minimal discharge of $NO_x$, CO, and HC's from the burner. If β is lengthened, for example by increasing the axial length of either the interior burner tile 212 or the refractory ring 198, while more HC's and CO will be burned, the production of $NO_x$ will increase. The considerations for the reverse angle α are the same as for the length β, which are to minimize the discharge of $NO_x$, CO, and HC's. If α is too large, there will be insufficient residence time and recirculation for second stage combustion. If α is too small, the flame of second stage combustion will not attach to the refractory baffle 126, causing flame instability.

The burner 100 of the present invention has two modes of operation, a low temperature mode and a high temperature mode. The low temperature mode is used during a cold furnace startup when the temperature of the furnace 300 is below the auto-ignition temperature of the fuel. The high temperature mode is used when the temperature of the furnace 300 is at or above the auto-ignition temperature of the fuel. Many of the internal burner elements 100 are primarily refractory and are capable of withstanding very high main combustion air preheat temperatures such as would be found with the use of a recuperator or regenerator.

Each of the two modes requires a different percentage of main combustion air to be directed to the first internal burner chamber air supply 160 for first and second stage combustion and to the second internal burner chamber air supply 248 for third stage combustion. The modes are controlled through the use of a switching valve assembly 230 within the main combustion air inlet section 144. The switching valve assembly 230 comprises a switching valve 154 and a switching plate 156, which are controlled through a control system as known in the art and a valve seat 254. The switching plate 156 has two positions, an open position 250 shown as solid lines in FIG. 1 and FIG. 9 and a closed position 252, shown in dashed lines in FIG. 1 and FIG. 9, where the switching plate 156 abuts and is held in place by a valve seat 254. In order to the control the position of the switching plate 156, the switching valve shaft 236 simply rotates 90 degrees via a control motor or manual operation, the switching plate 156 is located in the closed position 252 when the furnace temperature is at or above the auto-ignition temperature of the fuel and in the open position 250 when the furnace temperature is below the auto-ignition temperature of the fuel. The position of the switching plate 156 is dependent on the furnace temperature, which is measured by a furnace temperature sensor as known in the art. When the switching plate 156 is in the open position 250, about 30 to about 40 percent of the main combustion air is provided to the first internal burner chamber air supply 160 the balance of the main combustion air, depending on the size of the burner 100, is provided to the second internal burner chamber air supply 248. This operating mode is known as the 60/40 operating mode. When the switching plate 156 is in the closed position 252, about 3 to 10 percent of the main combustion air is provided to the first internal burner chamber air supply 160 and the balance of the main combustion air is provided to the second internal burner chamber air supply 248. This operating mode is known as the 90/10 operating mode.

Figure 9:
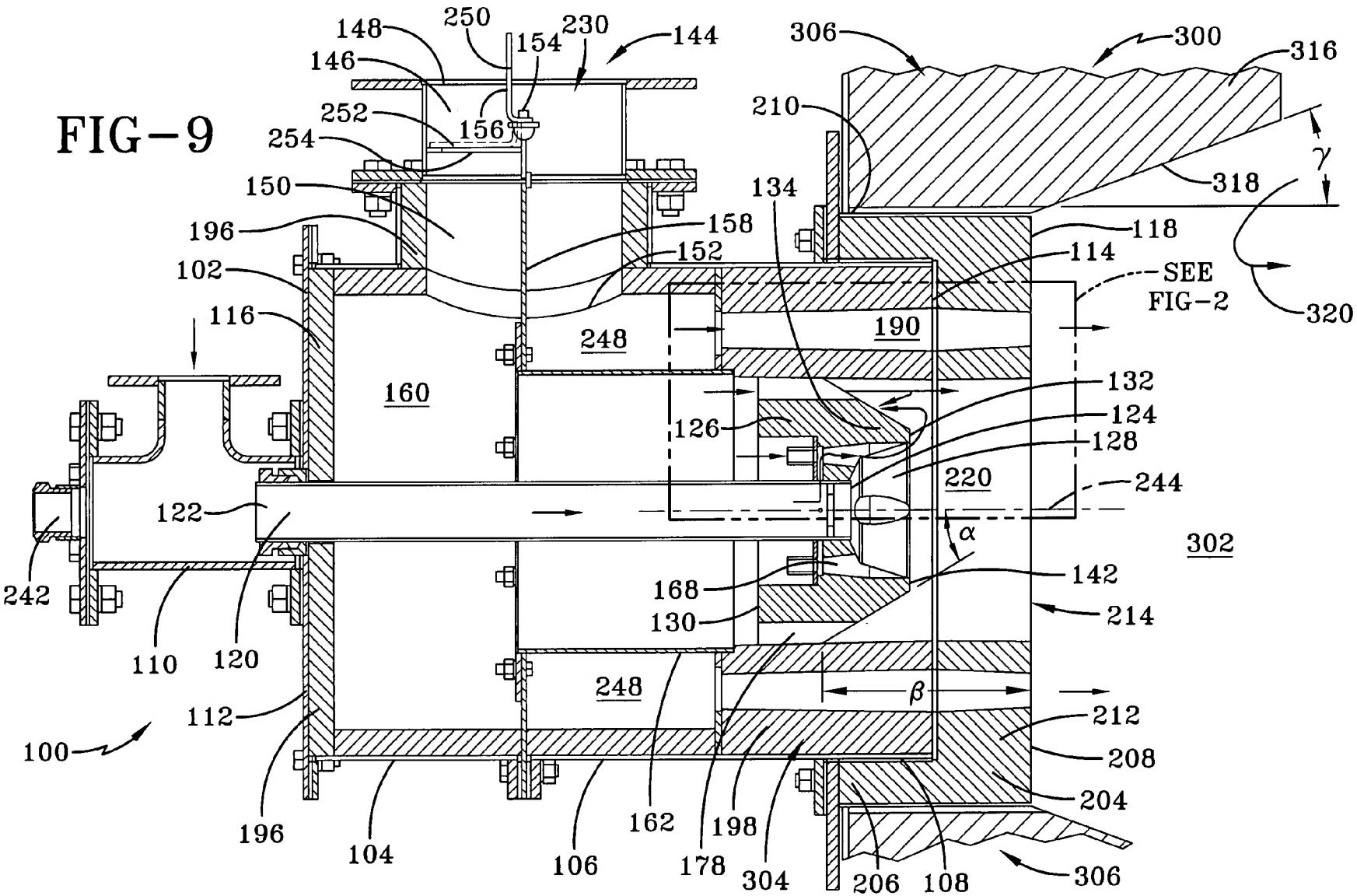
FIG. 9 is cross-sectional view of yet another alternate embodiment of the low $NO_x$ burner of the present invention.
Figure 10:
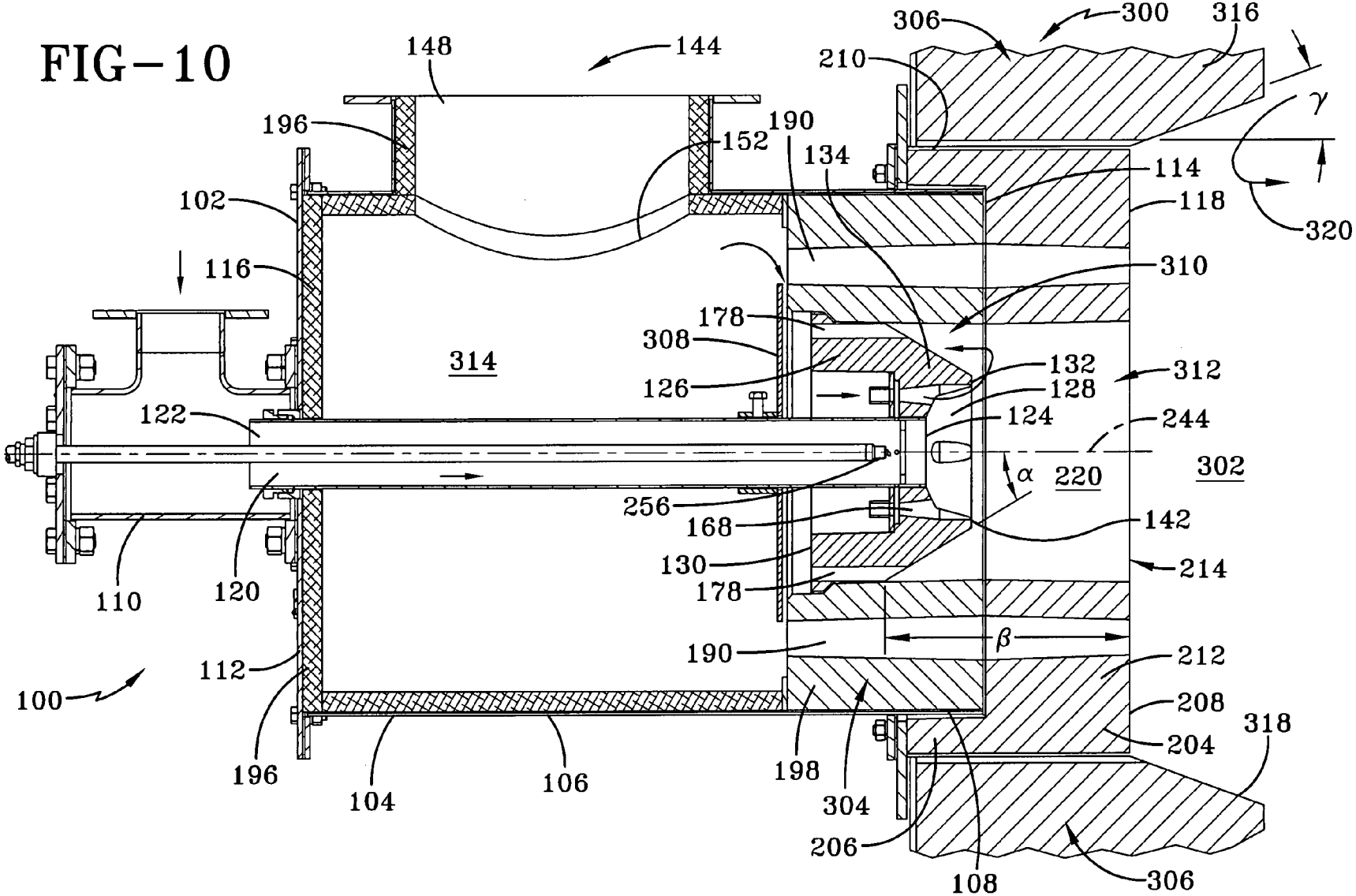
FIG. 10 is a cross-sectional view of another alternate embodiment of the low $NO_x$ burner of the present invention.
Figure 11:
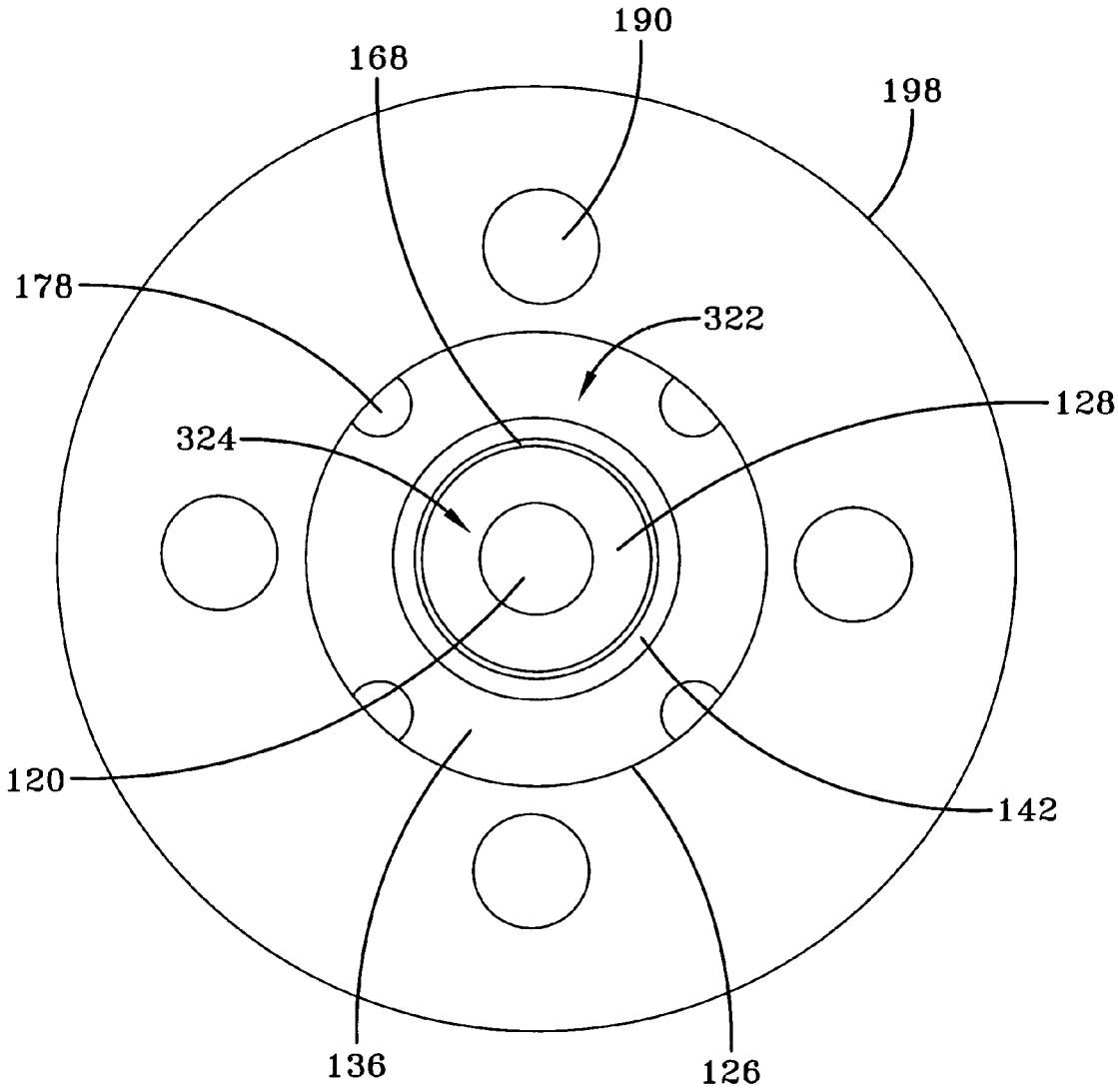
FIG. 11 is a yet another embodiment of the refractory baffle and refractory ring of the present invention.

In preferred embodiments of the present invention as shown in FIG. 9 and FIG. 10, the burner is used with a furnace that has a diverging port 316, comprising at least one diverging wall 318. The diverging wall 318 diverges from a plane that is perpendicular to the furnace wall at angle γ. In a preferred embodiment, the angle of divergence γ is about 15 degrees to about 35 degrees. In a more preferred embodiment, the angle of divergence γ is about 20 degrees. The diverging wall entrains products of combustion as shown at 320, which further reduces $NO_x$ production.

The burner 100 may also be designed to only fire in one mode, either the 60/40 mode or the 90/10 mode. In one alternative embodiment, where the burner 100 is only designed to fire in the 60/40 mode, the switching valve assembly 230, the divider plate 158, and the separation tube 162 are not required and are not present on the burner 100.

Figure 8:
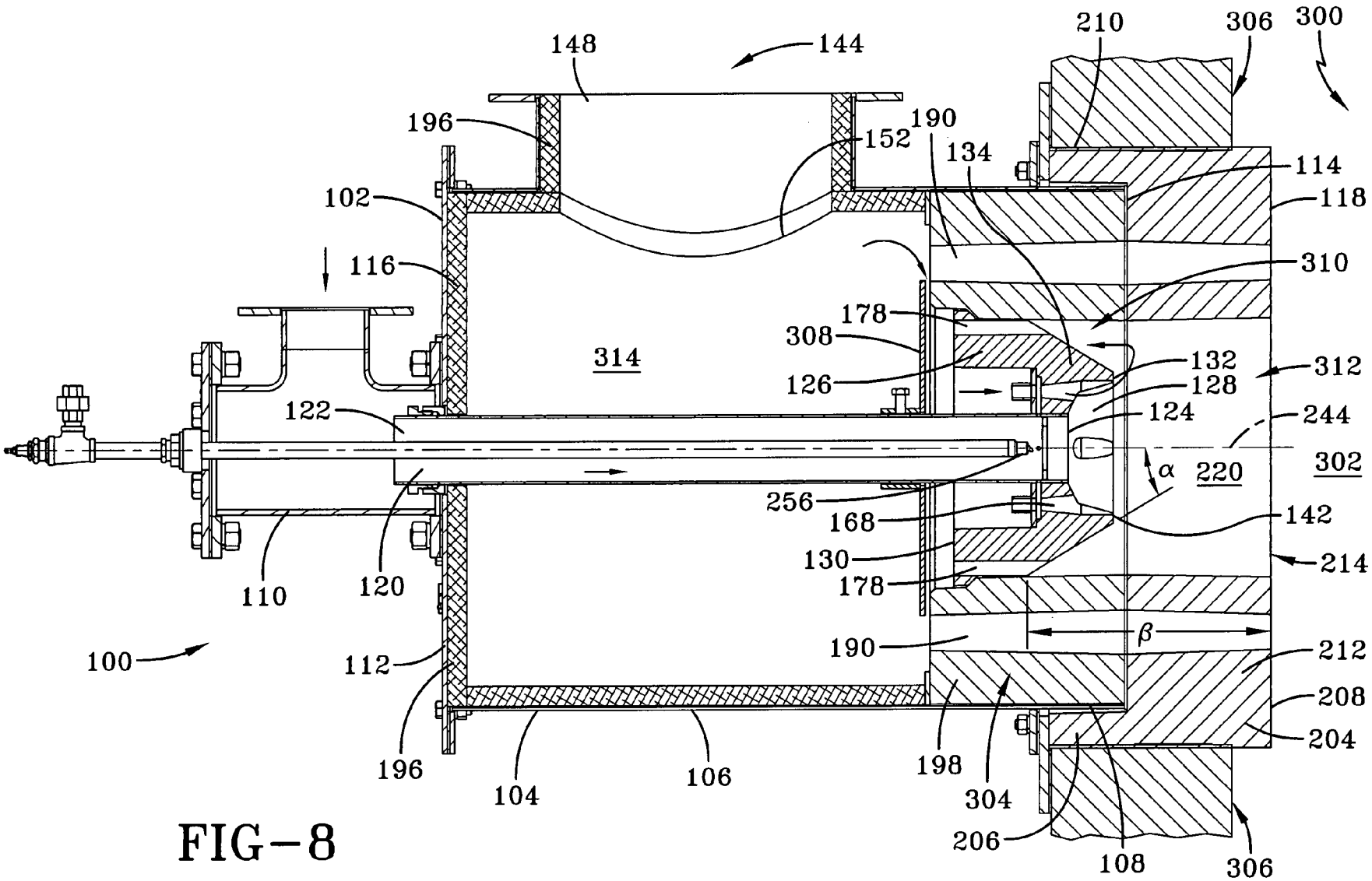
FIG. 8 is a cross-sectional view of an alternate embodiment of the low $NO_x$ burner of the present invention.

In another alternative embodiment, as shown in FIG. 8, where the burner 100 is only designed to fire in the 90/10 mode, the switching valve assembly 230, the divider plate 158, and the separation tube 162 are not required and are not present on the burner 100. A blocking plate 308 is present behind the refractory baffle 126. Instead of a first internal burner chamber air supply 160 and a second internal burner chamber air supply 248, there is only one main internal burner chamber air supply 314. The presence of the blocking plate causes only about 3 percent to about 10 percent of the main combustion air provided for first stage combustion and second stage combustion during burner operation with the balance of the main combustion air provided for third stage combustion. Since, in this embodiment, the burner is only designed to fire in the 90/10 mode, the burner cannot be used to preheat the furnace to the auto-ignition temperature of the fuel and an alternative method for preheating the furnace, such as auxiliary burners, is required.

When the burner 100 is operating in the 60/40 operating mode, the combination of first and second combustion stages in this low temperature mode of operation provides enhanced flame stability and adequate fuel burnout inside the burner tile, which is a function of residence time within the burner 100. The 60/40 operating mode is used when the temperature of the furnace is below the auto-ignition temperature of the fuel. A proper dimension β is important to insure the necessary residence time in the burner for sufficient first stage and second stage combustion. The addition of tertiary main combustion air, which is about 60 to 70 percent of the total air, downstream of the interior burner tile 212, in the interior 302 of furnace 300, assures nearly complete burnout of the remaining fuel for minimal CO and HC emissions. Meanwhile $NO_x$ emissions are still quite low as the $NO_x$ reducing benefits of partial air staging are in effect.

When the burner 100 is operating in the 90/10 operating mode, the result is 10 percent or less, preferably about 3 percent to about 10 percent, of the total air passing through the first stage and the second stage, while the balance of the main combustion air goes through the third stage directly into the interior 302 of the furnace 300. In this manner, there is still a visible and stable flame attached to the burner cup section 128 for first stage combustion, however, the remaining fuel combustion is substantially delayed with minimal second stage combustion and takes place mostly in the interior 302 of furnace 300 proper, resulting in reduced flame temperatures, which results in further $NO_x$ reduction. Since the combustion that takes place within the interior of the furnace occurs at or near furnace temperatures the portion of the flame that is within the interior of the furnace is largely invisible to the naked eye.

One of the advantages of the present invention over prior art burners is the reduction of harmful CO and HC emissions during startup, improved flame stability, and very low $NO_x$ emissions in both the 60/40 and 90/10 modes of operation. The modal burner design elements including the valve assembly 230 and the switching plate 156 and tube 162 serve to assist in the provision of a low emissions ($NO_x$, HC's, and CO) burner 100 for both the 60/40 and 90/10 modes of operation. The three stages of mixing and combustion of the fuel assist in providing the low emission benefits of the present invention. The venturi tube 246 promotes fuel and air mixing, burning, and flame stabilization for first stage combustion. The first stage combustion is important for flame stability in both the 60/40 and 90/10 modes of operation. The second stage combustion with reverse acute angle $\alpha$ is important to insure sufficient residence time and recirculation for the fuel and second stage main combustion air within burner 100 during the 60/40 mode of operation. The second stage combustion with reverse acute angle $\alpha$ and resulting negative pressure enhances flame stability in both the 60/40 and 90/10 modes of operation. The third stage combustion serves to complete the mixing and burning of partially combusted fuel and products of combustion, such as CO, from first stage combustion and second stage combustion along with any remaining uncombusted fuel, air, and furnace gases in both modes the 60/40 and 90/10 modes of operation. In addition, the tertiary main combustion air injection into the interior 302 of furnace 300 induces furnace flue gases prior to mixing and burning with the remaining fuel to complete combustion in the furnace 300 at lower flame temperatures. The lower flame temperatures in the third stage combustion region 222 produce lower $NO_x$ emissions as is known in the art.

As the present invention provides a burner 100 that is capable of very low $NO_x$ emissions with only one air inlet section 144 and only one fuel inlet section 110, the extra costs that are associated with the construction of additional air inlet sections and fuel inlet sections are avoided. The use of only one air inlet section 144 and one fuel inlet section 110 make the burner design of the present invention relatively easy to install, maintain, and operate. In addition, the present invention produces a visible and stable flame under all firing conditions, which promotes flame safety.

The burner 100 of the present invention can be produced in a various number of capacities, as measured by a fuel input energy of Million Btu/hr (MMBtu/hr). The smallest burner has a standard capacity of about 2 MMBtu/hr fuel input, while the largest burner has a capacity at or above about 25 MMBtu/hr, including among others 5 MMBtu/hr, 10 MMBtu/hr, 15 MMBtu/hr, and a 20 MMBtu/hr burner. Such energy outputs assume main combustion air pressure in the range of about 4 osig to about 12 osig. An increase in the primary air pressure would increase the energy output of the burner as more fuel could be supplied to the burner and combusted if it operated with a higher main combustion air pressure.

As additional excess air above and beyond the requirements for stoichiometric combustion increases the production of $NO_x$, excess main combustion air should be as low as possible to inhibit production of $NO_x$. While the burner 100 of the present invention will work well with about 10 percent to about 15 percent excess main combustion air, the burner 100 of the present invention should preferably be provided with less than 10 percent excess air and more preferably with about 5 percent excess air.

In addition, the burner 100 of the present invention is capable of high turndown, which means that its level of fuel input energy at maximum capacity is high relative to fuel input energy at minimum capacity for stable operation for that particular burner 100 embodiment. Generally, the burner 100 of the present invention is capable of being turned down to at least 8 to 1 while maintaining low excess air near stoichiometric operation. As an example, the specific burner 100 embodiment with capacity of 10 MMBtu/hr fuel energy input can be turned down to at least 1.25 MMBtu/hr without difficulty while maintaining low excess air with very low emissions of $NO_x$, CO and HC's. Such emissions generally depend on the firing rate (or thermal input), excess air conditions (with lower excess air being better), furnace temperature, air preheat temperature, and the mode in which the burner is operating. The 60/40 mode of operation results in higher $NO_x$ emissions than the 90/10 mode of operation.

For each size burner, the size of the downstream end section 176 of the primary main combustion air passage 168 and the associated venturi tube 246 are designed for drawing an appropriate amount of bleed fuel through venturi tube 246 and properly mixing the bleed fuel with primary main combustion air. The percentage of bleed fuel is in the range of about 1 percent to about 10 percent of the total fuel in the present invention. For example, for the 5 MMBtu/hr fuel energy input burner 100, the bleed fuel is in the range of about 3 percent to about 10 percent of the total fuel depending on the amount of fuel and main combustion air being provided to the burner 100. For the 20 MMBtu/hr burner 100, the bleed fuel is in the range of about 2 percent to about 5 percent depending on the amount of fuel and main combustion air being provided to the burner.

The ratio of primary main combustion air and secondary main combustion air (parts primary main combustion air: parts secondary main combustion air) is preferably in the range of about 1:5 to about 1:14.

In addition, the length $\beta$ varies depending on the burner size, but is designed to produce a residence time of partially burned products of combustion within the burner 100 so that CO and HCs are at least partially burned prior to exiting into the furnace 300 and subsequent mixing/burning with the tertiary main combustion air. For example, the preferred length $\beta$ is about 8 inches in the 5 MMBtu/hr burner 100 and about 14 inches in the 20 MMBtu/hr burner 100. Longer or shorter $\beta$ distances are envisioned for the present invention, however such longer and shorter $\beta$ distances generally result in increased $NO_x$ emissions. In addition, there is an preferred reverse acute angle $\alpha$ for each size burner 100 as well to minimize emissions. For example, the preferred value of $\alpha$ for the 5 MMBtu/hr burner 100 is about 59°. Other angles for $\alpha$ are envisioned for the present invention, however larger or smaller angles for $\alpha$ generally result in increased $NO_x$ emissions or reduced stability.

The burner of the present invention generally produces less NOx than prior art HM burners, such as those burners described in U.S. Pat. Nos. 4,431,403 and 4,443,182. When compared to such prior art HM burners, the burner of the present invention generally produces about 70 percent less $NO_x$ during normal firing in the 90/10 operating mode.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An air-staged low $NO_x$ burner for firing a gaseous fuel comprising:

a first downstream end and a first upstream end;

a main burner body having a second upstream end and a second downstream end;

a refractory baffle nested within the main burner body intermediate to the second upstream end and the second downstream end, the refractory baffle comprising a central axis, a third upstream end, a third downstream end, a downstream section having an outer surface to facilitate a portion of second stage combustion, a narrow portion at the third downstream end, and a wide portion upstream of the narrow portion, the outer surface of the downstream section converging toward the central axis of the refractory baffle at the third downstream end, and a burner cup section to promote a first stage combustion nested within the refractory baffle;

a fuel passage for supplying fuel for combustion, the fuel passage being in fluid communication with a fuel supply and the burner cup section of the refractory baffle, the fuel passage being nested within the refractory baffle;

a main combustion air inlet section for supplying main combustion air, the main combustion air inlet section being in fluid communication with a low pressure main combustion air supply and the refractory baffle;

a primary main combustion air passage having a fourth upstream end and a fourth downstream end and nested within the refractory baffle for supplying primary main combustion air to support fuel combustion in a first stage combustion region at a downstream end of the primary main combustion air passage and substantially within the burner cup, the primary main combustion air passage being in fluid communication with the main combustion air inlet section at the fourth upstream end, the first stage combustion region at the fourth downstream end, the fuel passage intermediate to the fourth upstream end and the fourth downstream end, and with the burner cup section at the fourth downstream end, the first stage combustion region positioned substantially within the burner cup section;

a secondary main combustion air passage having a fifth upstream end and a fifth downstream end and which passes through the refractory baffle for supplying secondary main combustion air for at least the second stage combustion to a second stage combustion region substantially within the main burner body, the second stage combustion region being located partially adjacent to and partially downstream of the third downstream end of the refractory baffle, the secondary main combustion air passage being in fluid communication with the main combustion air inlet section at the fifth upstream end and the second stage combustion region at the fifth downstream end; and a tertiary main combustion air passage having a sixth upstream end and a sixth downstream end downstream of the second downstream end of the main burner body for supplying tertiary main combustion air for a third stage combustion to a third stage combustion region, the tertiary main combustion air passage being in fluid communication with the main combustion air inlet section, the third stage combustion region being located downstream of the first downstream end.

2. The burner of claim 1, wherein the main combustion air has an inlet pressure of up to about 16 osig.

3. The burner of claim 2, wherein the secondary main combustion air passage has an upstream end section and a downstream end section, the downstream end section discharging main combustion air into the second stage combustion region, the second stage combustion region having an seventh upstream end and a seventh downstream end.

4. The burner of claim 3, wherein the distance between the seventh upstream end and the seventh downstream end of the second stage combustion region is in the range of about 6 inches to about 14 inches.

5. The burner of claim 2, wherein the refractory baffle additionally comprises a flat planar end surface to further facilitate second stage combustion at the third downstream end of the refractory baffle.

6. The burner of claim 2, further comprising a divider plate positioned within the main combustion air supply passage, the divider plate dividing the main combustion air into a first portion comprising primary main combustion air and secondary main combustion air and a second portion comprising tertiary main combustion air and a separation passage nested within the main burner body for directing the first portion of the main combustion air through the main burner body toward the downstream end of the main burner body.

7. The burner of claim 2, further comprising an ignition element for igniting at least one stage of combustion, the ignition element selected from the group consisting of a gas pilot ignition and a spark igniter.

8. The burner of claim 2, further comprising an interior burner tile and refractory ring, the refractory baffle being nested within the refractory ring, the interior burner tile comprising an internal chamber and an outer ring section and positioned at the downstream end of the burner within a furnace, the second stage combustion region additionally being at least substantially located within the internal chamber, the tertiary main combustion air passage being nested within the outer ring section of the interior burner tile and the refractory ring.

9. The burner of claim 3, further comprising a valve assembly for controlling a switching plate, the switching plate regulating the amount of main combustion air that is provided to the burner as primary main combustion air, secondary main combustion air, and tertiary main combustion air.

10. The burner of claim 5, further comprising at least one tube extending from outside the burner body into the second stage combustion region.

11. The burner of claim 10, wherein the number of tubes extending from outside the burner body into the second stage combustion region is in the range of one to four.

12. The burner of claim 8, further comprising an ignition element for igniting at least one stage of combustion, the ignition element selected from the group consisting of a gas pilot and a spark igniter.

13. The burner of claim 2, wherein there are four primary main combustion air passages.

14. The burner of claim 2, wherein at least a portion of the second stage combustion region is located substantially radially outward from the first stage combustion region with respect to the central axis.

15. The burner of claim 2, wherein at least a portion of the second stage combustion region is located upstream of the first stage combustion region.

16. The burner of claim 2, further comprising a blocking plate disposed upstream of the refractory baffle, the blocking plate regulating the supply of primary main combustion air, secondary main combustion air, and tertiary main combustion air.

17. The burner of claim 2, wherein the angle of convergence of the outer surface of the refractory baffle toward the central axis of the refractory baffle is an acute angle with respect to the central axis.

18. The burner of claim 17, wherein the outer surface of the downstream section of the refractory baffle is substantially frustro-conical.

19. The burner of claim 18, wherein the angle of convergence is in the range of about 25 degrees to about 70 degrees.

20. The burner of claim 12, wherein the number of primary main combustion air passages is in the range of 1 to 6.

21. The burner of claim 12, wherein the number of secondary main combustion air passages is in the range of 2 to 8.

22. The burner of claim 12, wherein the number of tertiary main combustion air passages is in the range of 2 to 8.

23. The burner of claim 2, wherein the main combustion air has an inlet pressure of up to about 12 osig.

24. An air-staged low $NO_x$ burner for firing using a gaseous fuel comprising:

a first upstream end and a first downstream end;

a main burner body having a second upstream end and a second downstream end;

a refractory baffle nested within the main burner body intermediate to the second upstream end and the second downstream end, the refractory baffle having a third upstream end and a third downstream end and being configured to facilitate first stage combustion in a first stage combustion region substantially within the baffle and being configured to facilitate second stage combustion in a second stage combustion region partially adjacent to an outer surface of the baffle by promoting a negative pressure zone upstream of the third downstream end, the second stage combustion region also being partially downstream of the third downstream end;

a fuel passage for supplying fuel for combustion, the fuel passage being in fluid communication with a fuel supply and the burner cup section of the refractory baffle, the fuel passage being nested within the refractory baffle;

a main combustion air inlet section for supplying main combustion air, the main combustion air inlet section being in fluid communication with a low pressure main combustion air supply and the refractory baffle;

a primary main combustion air passage having a fourth upstream end and a fourth downstream end and being nested within the refractory baffle for supplying primary main combustion air to support fuel combustion in a first stage combustion region at a downstream end of the primary main combustion region and substantially within the burner cup, the primary main combustion air passage being in fluid communication with the main combustion air inlet section at the fourth upstream end, the first stage combustion region at the fourth downstream end, the fuel passage intermediate to the fourth upstream end and the fourth downstream end, and with the first stage combustion section at the fourth downstream end;

a secondary main combustion air passage having a fifth upstream end and a fifth downstream end and nested within the refractory baffle for supplying secondary main combustion air for at least second stage combustion to the second stage combustion region, the second stage combustion region being located partially adjacent to and partially downstream of the outer surface of the refractory baffle, the secondary main combustion air passage being in fluid communication with the main combustion air inlet section at the fifth upstream end and the second stage combustion region at the fifth downstream end; and a tertiary main combustion air passage having a sixth upstream end and a sixth downstream end downstream of the second downstream end of the main burner body for supplying tertiary main combustion air for third stage combustion to a third stage combustion region, the tertiary main combustion air passage being in fluid communication with the main combustion air inlet section, the third stage combustion region being located downstream of the second downstream end.

25. A method for low $NO_x$ staged combustion, comprising the steps of:

providing main combustion air from a main combustion air supply, the main combustion air supply being in fluid communication with a burner;

introducing the main combustion air into the burner and dividing the main combustion air within the burner into a primary main combustion air stream, a secondary main combustion air stream, and a tertiary main combustion air stream;

providing fuel for combustion from a fuel supply, the fuel supply being in fluid communication with a fuel passage;

introducing the fuel into the fuel passage;

flowing the primary main combustion air stream into a burner cup section of a refractory baffle, the burner cup section being in fluid communication with the fuel passage, the refractory baffle being nested within the burner and having and upstream end and a downstream end;

drawing a first portion of the fuel into the burner cup section, while mixing the first portion of fuel with the primary main combustion air stream to form a first mixture;

at least partially combusting the first mixture substantially within the burner cup section by igniting the first mixture for a first stage of combustion;

introducing the secondary main combustion air stream adjacent to an outer surface of the baffle, wherein the interaction between the secondary main combustion air stream and the outer surface of the baffle creates a negative pressure zone at least upstream of the downstream end of the baffle;

drawing at least a second portion of the fuel into the negative pressure zone, which drawing, in conjunction with the introduction of the secondary main combustion air stream creates a second mixture;

at least partially combusting the second mixture at least partially within the negative pressure zone by igniting the second mixture for a second stage of combustion;

flowing the products of the first stage of combustion and the second stage of combustion along with any uncombusted fuel and any unreacted primary main combustion air and secondary main combustion air into the furnace;

introducing the tertiary main combustion air stream into a furnace;

igniting substantially all of the uncombusted fuel in the furnace for a third stage of combustion.

26. The method of claim 25 wherein the tertiary main combustion air stream is introduced into a diverging port section of the furnace and the products of the first stage of combustion and the second stage of combustion along with any uncombusted fuel and any unreacted primary main combustion air and secondary main combustion are flowed into a diverging port section of the furnace, the diverging portion section facilitating the entrainment of a portion of the products of combustion, the diverging port section having at least one wall that diverges from a plane that is perpendicular to a furnace wall into which the burner extends.

27. The method of claim 26, wherein the diverging port has an angle of divergence, with respect to the plane that is perpendicular to the furnace wall, in the range of about 15 degrees to about 35 degrees.

28. The method of claim 27, wherein the diverging port has an angle of divergence of about 20 degrees.

29. The method of claim 25, wherein the main combustion air is provided at a pressure of up to about 16 osig.

30. The method of claim 21, wherein the main combustion air is provided at a pressure of up to about 12 osig.

31. The method of claim 25, wherein excess main combustion air provided for combustion is less than about 15 percent more than is required for stoichiometric combustion.

32. The method of claim 31 wherein the excess air provided for combustion is less than about 5 percent more than is required for stoichiometric combustion.

33. The method of claim 25, wherein at least a portion of the second stage of combustion occurs in a burner chamber downstream of the refractory baffle, the chamber being in fluid communication with a furnace.

34. The method of claim 25, wherein the primary main combustion air stream and the secondary main combustion air stream are first directed into a first internal burner chamber air supply before entering into the primary main combustion air passage and secondary main combustion air passage respectively and wherein the tertiary main combustion air stream is first directed into a second internal burner chamber air supply before entering into the tertiary main combustion air passage.

35. The method of claim 34, wherein the main combustion air flow to the primary main combustion air passage is controlled through the use of a switching assembly.

36. The method of claim 25, wherein the switching assembly is electrically powered and attached to an electric power supply.

37. The method of claim 35, wherein the main combustion air flow is able to be switched through the use of the switching assembly from a mode in which a percentage of the main combustion air provided to the first internal burner chamber air supply is in the range of about 30 percent to 40 percent and a balance of the main combustion air is provided to the second internal burner chamber air supply to a mode in which a percentage of the main combustion air provided to the first internal burner chamber air supply is in the range of about 3 percent to about 10 percent and a balance of the main combustion air is provided to the second internal burner chamber air supply.

38. The method of claim 25, wherein the first portion of fuel comprises about 1 percent to about 10 percent of the total fuel for combustion.

39. The method of claim 25, wherein the main combustion airflow to the primary main combustion air passage and the secondary main combustion air passage is regulated through the use of a blocking plate.

40. The method of claim 25, wherein the use of the blocking plate causes about 3 percent to about 10 percent of the main combustion air to be provided to the primary main combustion air passage and the secondary main combustion air passage.

41. The method of claim 25, wherein there are a plurality of primary main combustion air passages and a plurality of secondary main combustion air passages.

* * * * *

UNITED STATES PATENT AND TRADEMARK OFFICE

CERTIFICATE OF CORRECTION

PATENT NO. : 7,163,392 B2
APPLICATION NO. : 10/933840
DATED : January 16, 2007
INVENTOR(S) : Feese et al.

It is certified that error appears in the above-identified patent and that said Letters Patent is hereby corrected as shown below:

In column 6, line 13 “file” should be -- tile --.

Signed and Sealed this

Tenth Day of April, 2007

JON W. DUDAS
*Director of the United States Patent and Trademark Office*